US005119891A

United States Patent [19]

Flynn

[11] Patent Number: 5,119,891

[45] Date of Patent: Jun. 9, 1992

[54] ADAPTOR FOR DRILLING STRINGS WITH CONTROLLABLE AIR PASSAGE

[75] Inventor: Darcy L. Flynn, Queensland, Australia

[73] Assignee: S & T NO 13 Pty Ltd., Townsville, Australia

[21] Appl. No.: 588,100

[22] Filed: Sep. 25, 1990

Related U.S. Application Data

[63] Continuation-in-part of Ser. No. 374,133, Jun. 30, 1989, Pat. No. 4,974,690.

[30] Foreign Application Priority Data

Oct. 31, 1988 [AU] Australia ..... 24479/88
Sep. 14, 1990 [AU] Australia ..... PK2302

[51] Int. Cl.[5] ..... E21B 21/00; E21B 21/10

[52] U.S. Cl. ..... 175/317; 175/243; 175/318

[58] Field of Search ..... 175/234, 235, 243, 317, 175/318, 324; 173/139

[56] References Cited

U.S. PATENT DOCUMENTS 1,619,328 3/1927 Benckenstein ..... 175/243 X
2,805,043 9/1957 Williams, Jr. ..... 175/324 X
2,869,828 1/1959 McClinton ..... 175/295
2,906,493 9/1959 Whitener ..... 175/324 X

FOREIGN PATENT DOCUMENTS 232880 11/1968 U.S.S.R. ..... 175/317
825838 5/1981 U.S.S.R. ..... 175/322

*Primary Examiner*—David J. Bagnell
*Attorney, Agent, or Firm*—Oblon, Spivak, McClelland, Maier & Neustadt

[57] ABSTRACT

An adaptor for drilling strings has a head, sleeve and mounting block assembly to secure a drill bit to a drilling string. By reverse rotation of the drilling string, the sleeve is movable between a first position, where pressurized air from the drilling string is directed to the drill bit, to a second position, where the air is directed to the drill hole above the adaptor to clear debris from the hole. Teeth at both ends of the drill assist the adaptor to clear the hole as the drill string is rotated and retracted from the hole.

4 Claims, 11 Drawing Sheets

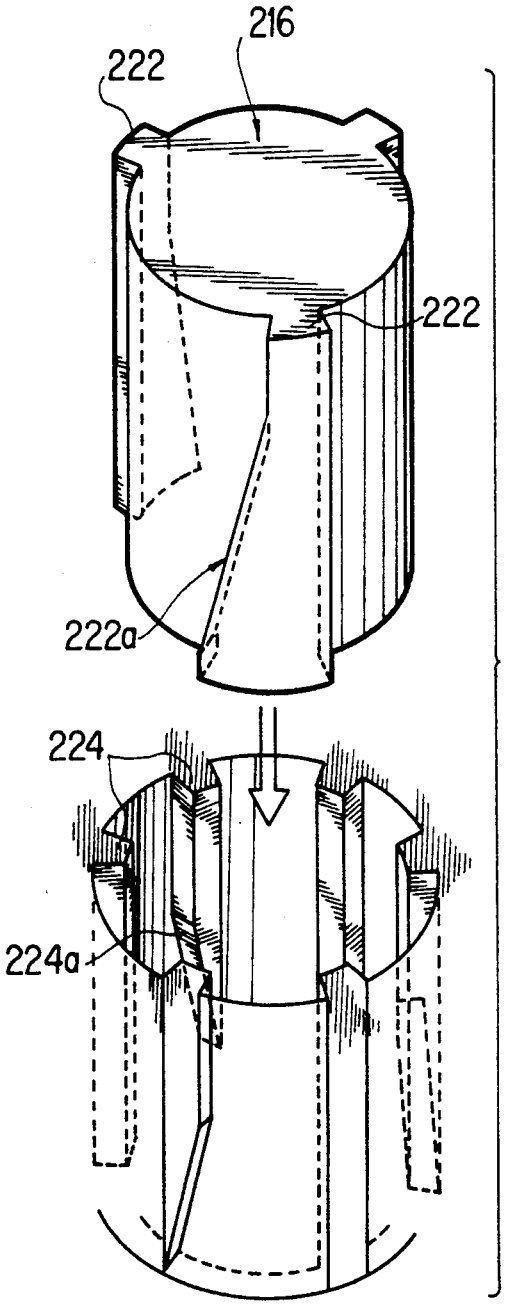
FIG.10
FIG.11
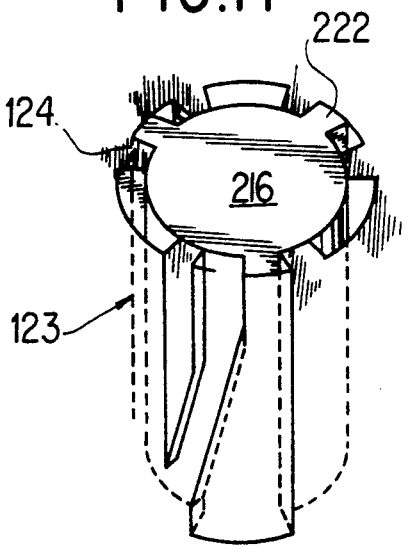
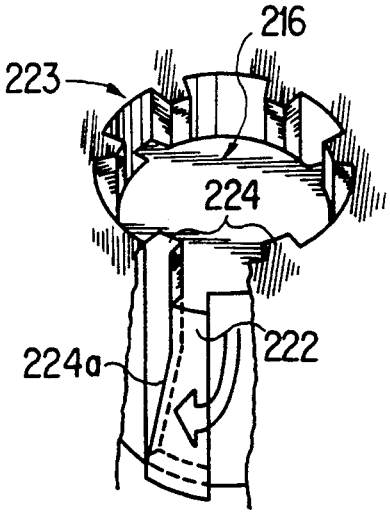
FIG.12

ADAPTOR FOR DRILLING STRINGS WITH CONTROLLABLE AIR PASSAGE

This application is a continuation-in-part (CIP) of Ser. No. 07/374,133, filed Jun. 30, 1989, now U.S. Pat. No. 4,974,690.

BACKGROUND OF THE INVENTION

1. Field of the Invention

THIS INVENTION relates to improvements in drilling equipment.

2. Description of the Prior Art

The operator of a drilling rig must operate the rig under a number of conflicting conditions. As he is paid by the meter depth drilled, a high drilling rate increases his operating profit on the rig. However, a loss of the drilling equipment (e.g. the hammer and/or drilling bit) down the hole can result in a monetary loss of $50,000 (Aust.) plus, easily cancelling the operating profits.

Generally the drilling equipment is lost due to a collapse of the hole wall above the drilling equipment, the dislodged material jamming the drilling equipment down the hole. The collapse may be due to a physical failure in the soil stratum around the hole, or the dislodgement of rocks or soil from the wall of the hole by the drilling equipment as it is withdrawn from the hole or while geological samples are being taken. In certain areas of Western Australia, the clay strata at a depth around the hole swells to "choke" the hole, when contacted by ground water from another level in the hole.

When the hole wall collapses, or the clay chokes the hole, the operator either has to abandon the drilling equipment down the hole or use a second rig to try to recover the equipment by drilling a second hole closely adjacent the first. It will be readily apparent to the skilled addressee that the second rig could suffer the same fate as the first rig.

SUMMARY OF THE PRESENT INVENTION

It is an object of the present invention to provide an adaptor for drilling strings which can enable the downhole equipment to be recovered.

It is a preferred object to provide an adaptor where air can be used to flush the hole.

It is a further preferred object to provide an adaptor which can cut its own way out of the hole.

It is a still further preferred object to provide an adaptor which enables grout or the like to be pumped down the hole to stabilize the hole.

It is a still further preferred object to provide an adaptor which can stabilize the drilling strings and which can be used to connect percussion hammers, cross-over-subs, drilling bits and the like to the drilling strings.

Other preferred objects will become apparent from the following description.

One aspect of the present invention resides in an adaptor for drilling strings including:

a body having a head screw-threadably mountable on the lower end of a drilling string, having at least one intake passage extending substantially radially through the body and arranged to communicate with a pressure pipe in the drilling string;

a sleeve rotatably mounted on the body and longitudinally movable relative thereto;

a mounting block mountable on the lower end of the sleeve and movable therewith relative to the body and arranged for connecting to drilling equipment and having at least one air intake passage connectable with an air intake port in the drilling equipment; and air passage means between the intake passage defined between the body and the sleeve arranged to connect the intake passage in the body to the air intake passage in the mounting block;

the foregoing being so arranged that in a first position of the sleeve relative to the body, pressurized air from the pressure pipe is directed through the intake passage in the body, the air passage means and the air intake passage in the mounting block to the air intake port of the drilling equipment; and in a second position of the sleeve relative to the body, the pressurized air is directed by the intake passage to the drill hole above the adaptor to clear debris from the drill hole.

The term "drilling equipment" shall be used to include a drilling bit, a cross-over-sub, a percussion hammer or like drilling equipment.

A second aspect of the present invention resides in an adaptor in a drilling string for a percussion hammer or a rotary drill bit including:

a body having a head screw-threadably mountable on the lower end of a drilling string, and having at least one intake passage extending substantially radially through the body and arranged to communicate with the pressure pipe of the drilling string;

a sleeve rotatably mounted on the body and longitudinally movable relative thereto;

a mounting block mountable on the lower end of the sleeve and movable therewith relative to the body and arranged for connection to a percussion hammer or drilling bit and having at least one air intake passage connectable with an air intake port in the percussion hammer or drilling bit;

a first variable volume chamber defined by the body and the sleeve;

a second variable volume chamber defined by the body, sleeve and the mounting block; and air passage means connecting the first and second chambers;

the foregoing being so arranged that in a first position of the sleeve relative to the body, pressurized air from pressure pipe is directed through the intake passage in the body to the first chamber, along the air passage means to the second chamber, and through the air intake passage in the mounting block to the air intake port in the percussion hammer or the drilling bit, and in a second position of the sleeve relative to the body where the pressurized air is directed into the drill hole above the adaptor to clear debris from the drill hole.

In a third aspect the present invention resides in an adaptor for reverse circulation drilling strings including:

a body having a head screw-threadably mountable on the lower end of a drilling string, a substantially central exhaust passage to communicate with the exhaust pipe of the drilling string and at least one intake passage extending substantially radially through the body and arranged to communicate with a pressure pipe of the drilling string, the pressure pipe surrounding the exhaust pipe;

a sleeve member rotatably mounted on the body and longitudinally movable relative thereto;

a mounting block mountable on the lower end of the sleeve and movable therewith relative to the body and arranged for connection to drilling equipment and having a substantially central exhaust passage to provide a connection between the exhaust passage in the body and an exhaust port in the drilling equipment and at least one air intake passage connectable with an air intake port in the drilling equipment;

a first variable volume chamber defined by the body and the sleeve;

a second variable volume chamber defined by the body, the sleeve and the mounting block; and air passage means connecting the first and second chambers;

the foregoing being so arranged that in a first position of the sleeve relative to the body, pressurized air from the pressure pipe is directed through the intake passage to the first chamber along the air passage means to the second chamber, and through the air intake passage in the mounting block to the air intake port in the drilling equipment, and in a second position, where the pressurized air is directed into the drill hole above the adaptor to clear debris from the hole.

Preferably the sleeve and body are provided with complementary helical splines or vertical guides with inclined faces to enable the sleeve to move rotatably and longitudinally relative to the body.

Preferably, in the reverse circulation adaptor, the mounting block has a tubular upper portion slidably received in the exhaust passage of the body to provide communication with that passage and the exhaust passage in the mounting block.

Preferably cutting teeth, which may have hardened (e.g. tungsten-carbide) inserts are provided around the periphery of the upper end of the sleeve to enable the adaptor (and any attached drilling equipment) to be cut free of debris in the hole when the drilling string is rotated and retracted. Similar cutting teeth may also be provided around the lower end of the sleeve.

BRIEF DESCRIPTION OF THE DRAWINGS

To enable the invention to be fully understood, a preferred embodiment will now be described with reference to the accompanying drawings, in which:

FIG. 10 is an exploded schematic isometric view of the body and sleeve showing alternative vertical guide and ramp means to allow rotational longitudinal movement between the body and sleeve;

FIGS. 11 and 12 are schematic isometric views showing the sleeve in its respective positions in the drilling and flushing or withdrawal modes;

DESCRIPTION OF THE PREFERRED EMBODIMENTS

Figure 1:
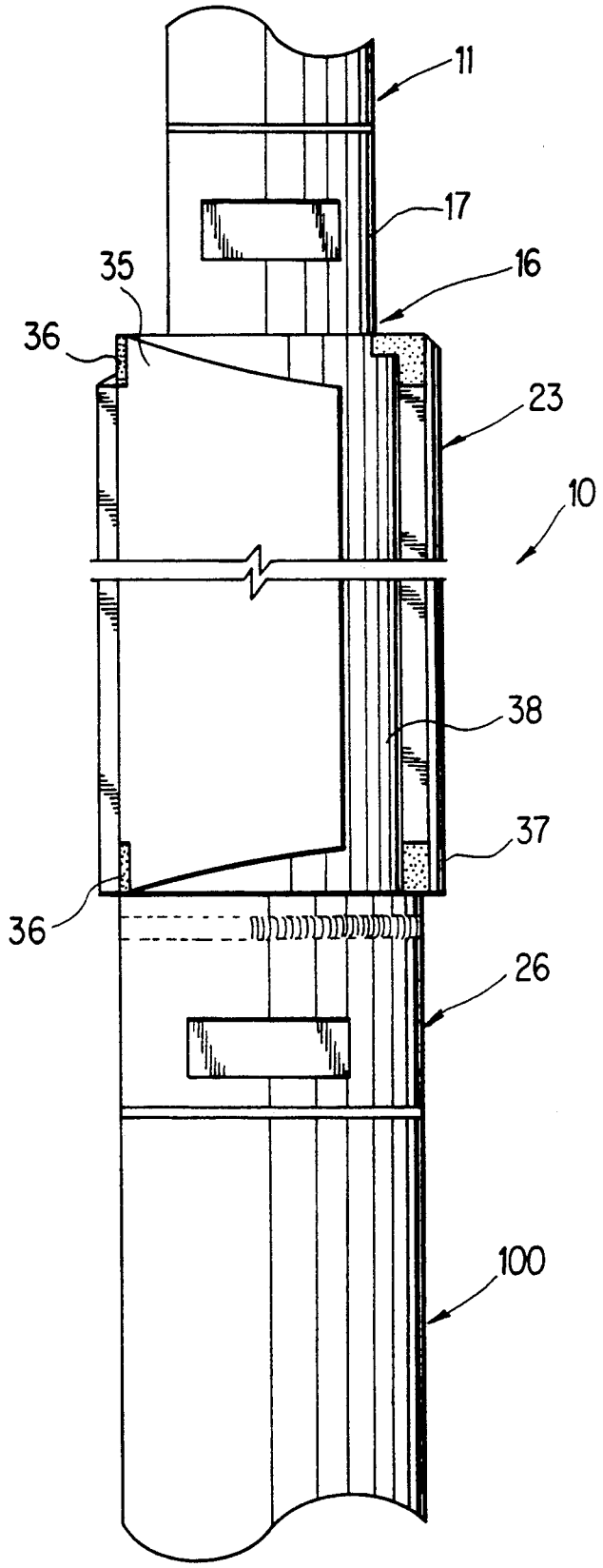
FIG. 1 is a side view of a reverse circulation adaptor connecting a hammer to a drilling string.
Figure 2:
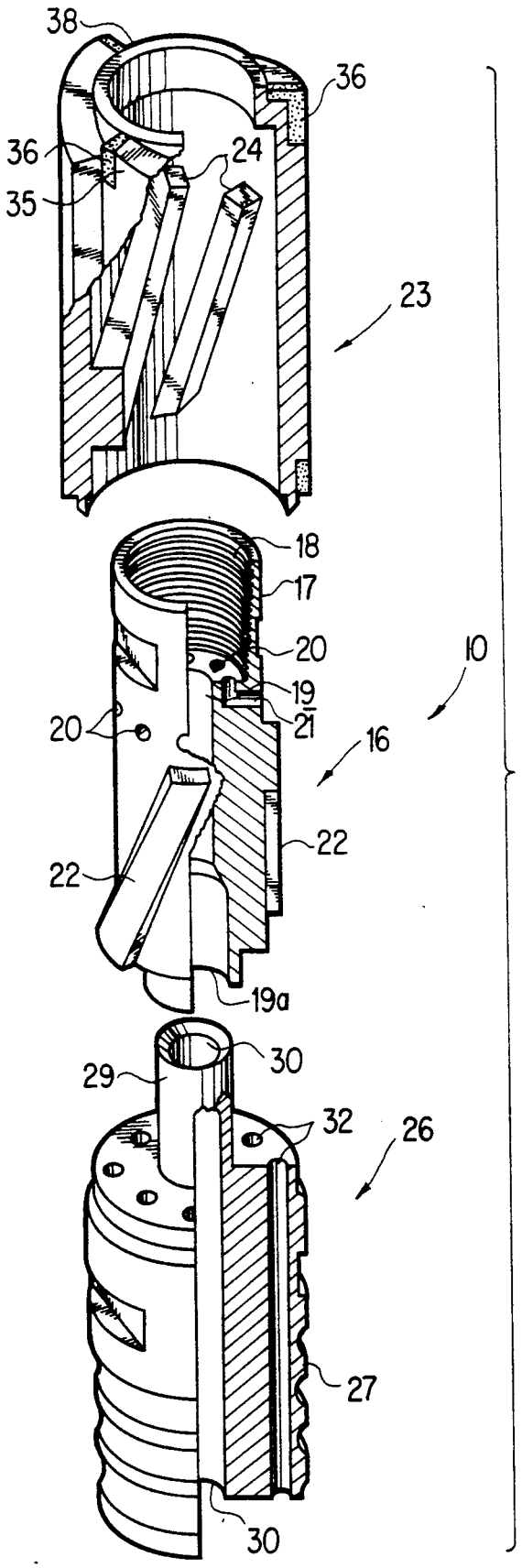
FIG. 2 is an exploded, part-sectional view of the adaptor components.

Referring to FIGS. 1 to 5, the adaptor 10 is attached at the lower end of a drilling string 11 (shown in dashed lines in FIGS. 3 and 4) which has inner and outer pipes 12, 13 forming co-axial pressure and exhaust passages 14, 15. A reverse circulation pneumatic hammer 100, with a drill bit 101, is attached to the lower end of the adaptor 10.

The adaptor body 16 has a head 17 with a tapered, screw-threaded bore 18, to enable it to be screwed onto the lower end of the drilling string 11.

A central exhaust passage 19, with an enlarged lower portion 19*a*, extends through the body and communicates with the exhaust passage 15.

A plurality of intake ports 20 in the head 17 communicate with the pressure passage 14 and with radially extending intake passages 21.

Three helical splines 22 are provided around, and extend down, the body 16.

The sleeve 23 has pairs of internal helical splines 24 engaged with the splines 22 on the body 16 to enable the sleeve 23 to move rotatably and longitudinally with respect to the body. When the sleeve 23 is mounted on the body 16, intake passages 25 are defined by the sleeve and the body, between the pairs of helical splines 24.

A mounting block 26 is welded to the lower end of the sleeve 23 and has helical splines 27 engageable in a socket 28 at the upper end of the hammer 100. A tubular extension 29 on the mounting block 26 is slidably and rotatably received within the exhaust passage 19*a* in the body. An exhaust passage 30, connected to the exhaust port 31 in the hammer 100, extends up through the mounting block 26 and communicates with the exhaust passage 19*a* in the body 16.

A plurality of intake passages 32 extend down through the mounting block 26 and communicate with intake ports (not shown) in the hammer 100.

A first variable passage chamber 33 is defined by the body 16 and sleeve 23 and is connected by the intake passages 25 to a second variable volume chamber 34 defined by the body 16, sleeve 23 and mounting block 26. The chambers 33, 34 provide manifolds interconnecting the intake passages 21 and passages 25, and the passages 25 and intake passages 32 respectively.

A plurality of upwardly directed teeth 35, with tungsten-carbide cutting inserts 36, are provided around the periphery of the upper end of the sleeve 23, and similar teeth 37, with inserts 36, around the periphery of the lower end of the sleeve 23. The upper and lower teeth 35, 37 are aligned and respective teeth are separated by vertical grooves or reliefs 38.

Figure 3:
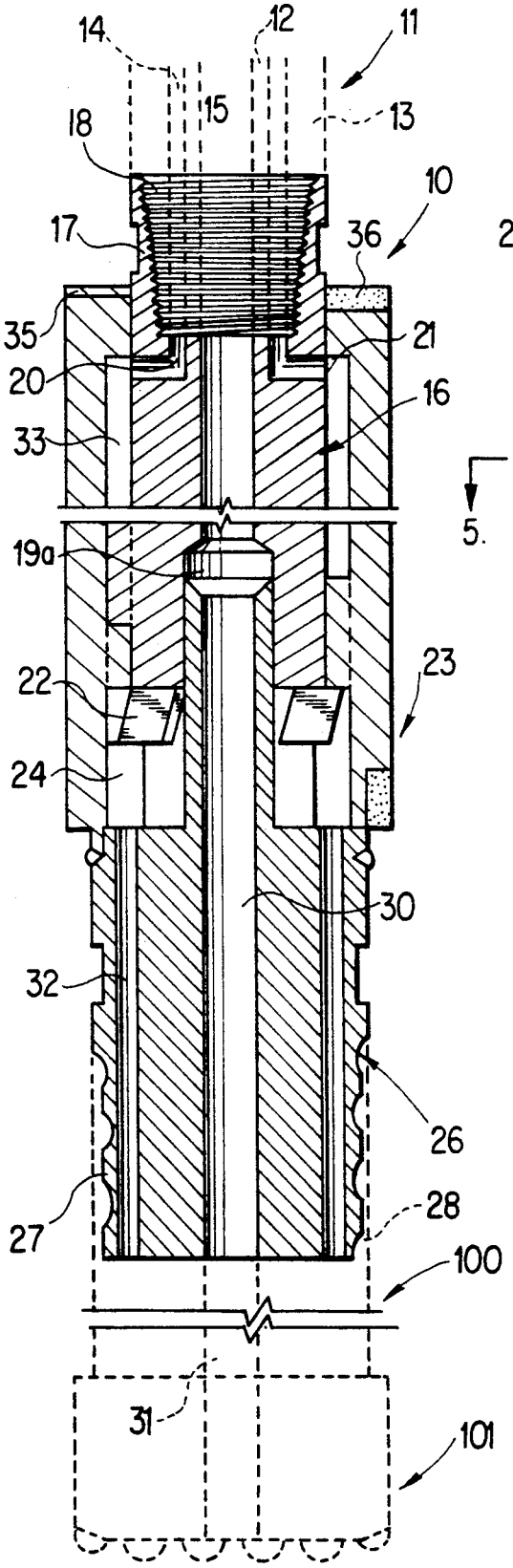
FIG. 3 is a sectional side view of the adaptor in the drilling mode.

In the drilling mode shown in FIG. 3, the pressurized air from the pressure passage 14 of the drilling string is directed via the intake ports 20 and the intake passages 21 into the first chamber 33, down the air passages 25 to the second chamber 34 and then via air intake passages 32 to the intake ports of the hammer 100. The exhaust air, carrying the drilled earth, travels up the exhaust passages 31, 19*a*, 19 to the exhaust passage 15 in the drilling string 11.

Figure 4:
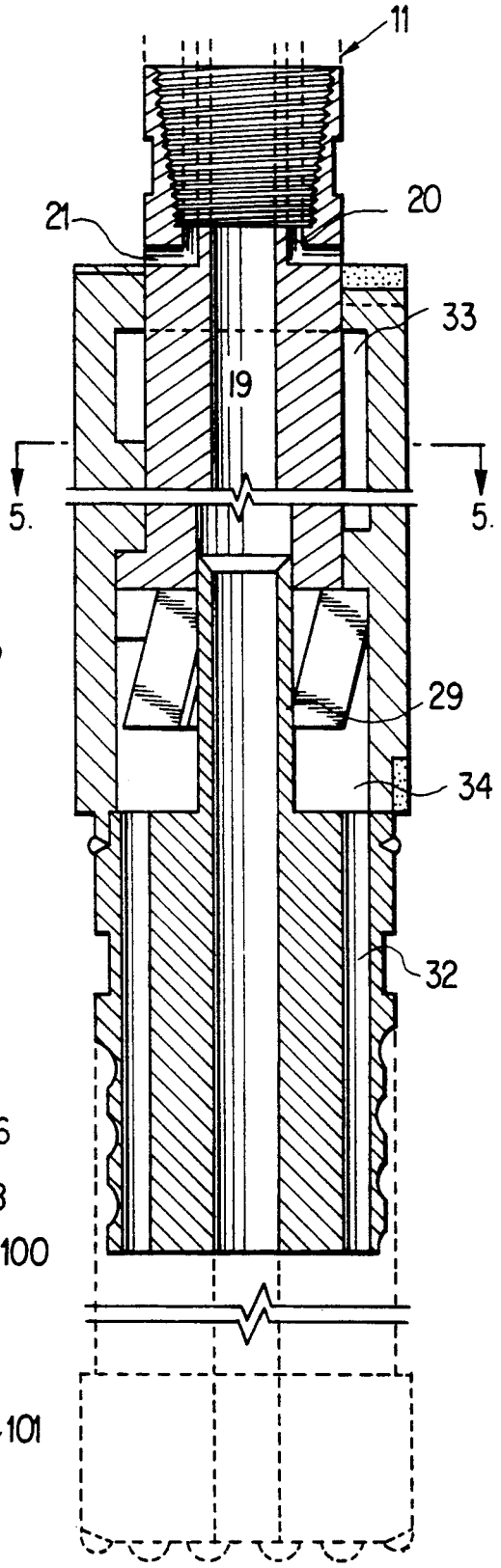
FIG. 4 is a similar view with the adaptor in its flushing or withdrawal mode.
Figure 5:
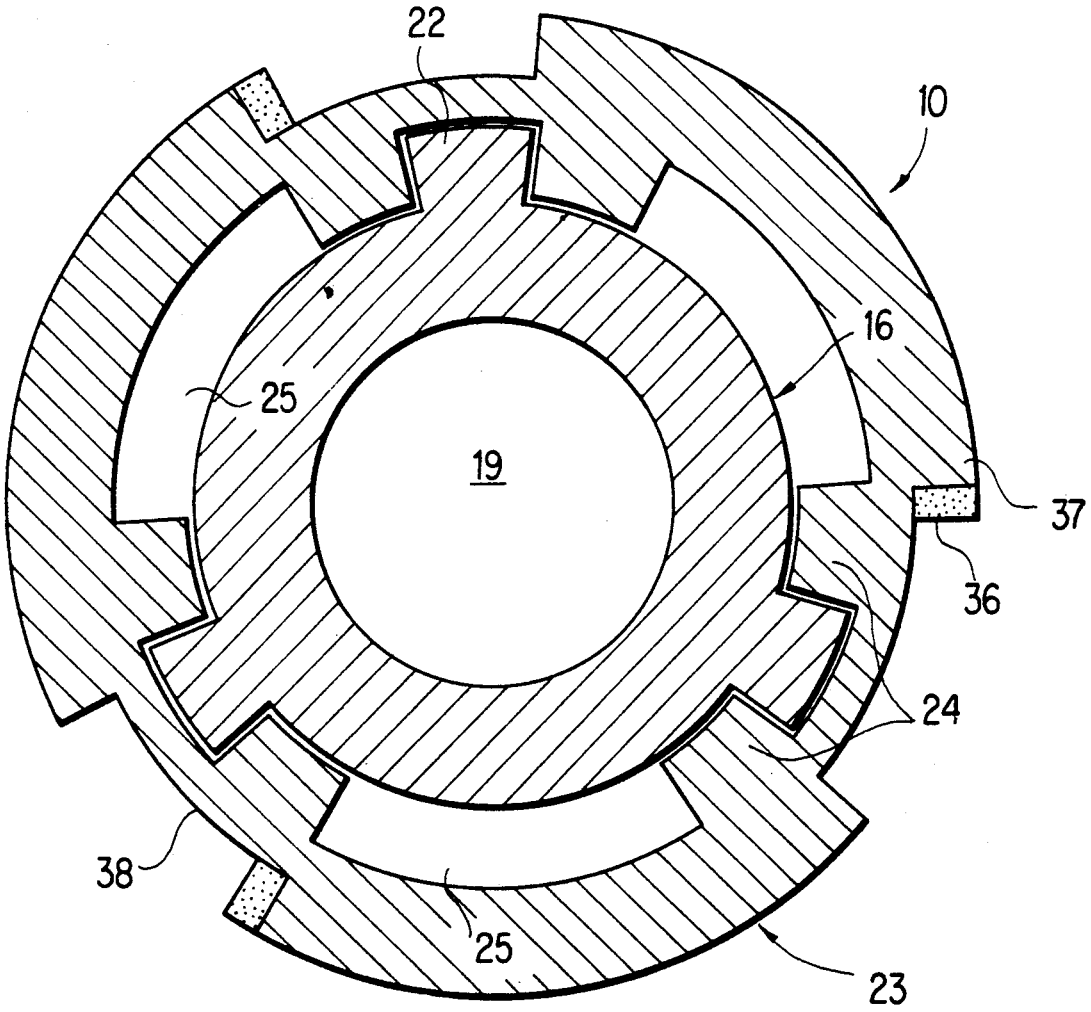
FIG. 5 is a sectional plan view of the adaptor taken on line 5—5 on FIG. 4.
Figure 6:
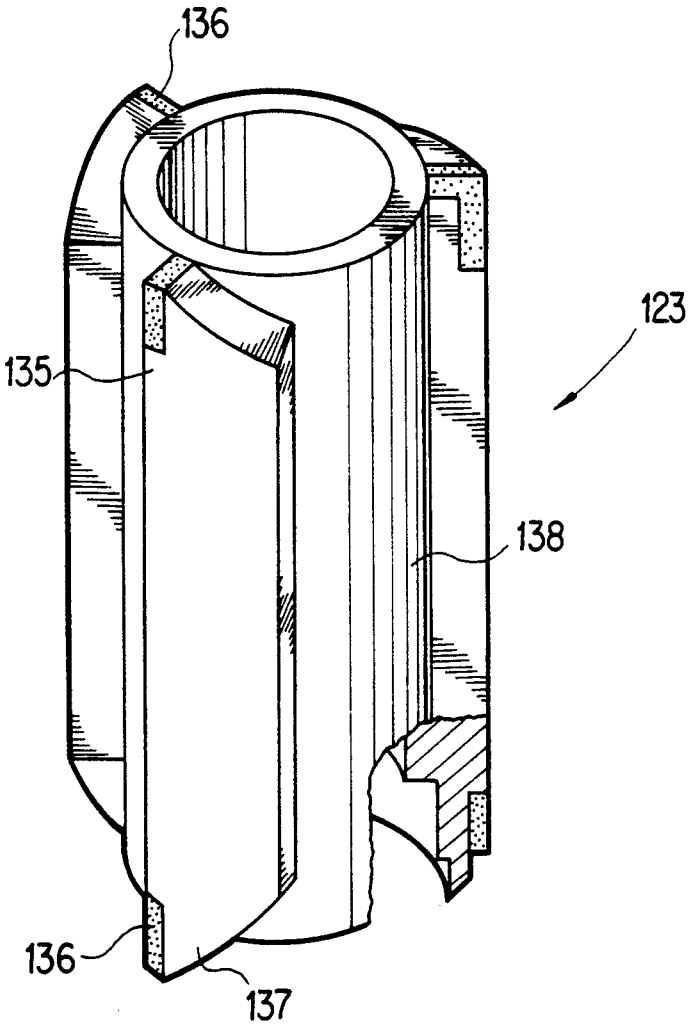
FIG. 6 is a part-sectional isometric view of the sleeve of an adaptor for a percussion hammer or rotary drill.
Figure 6A:
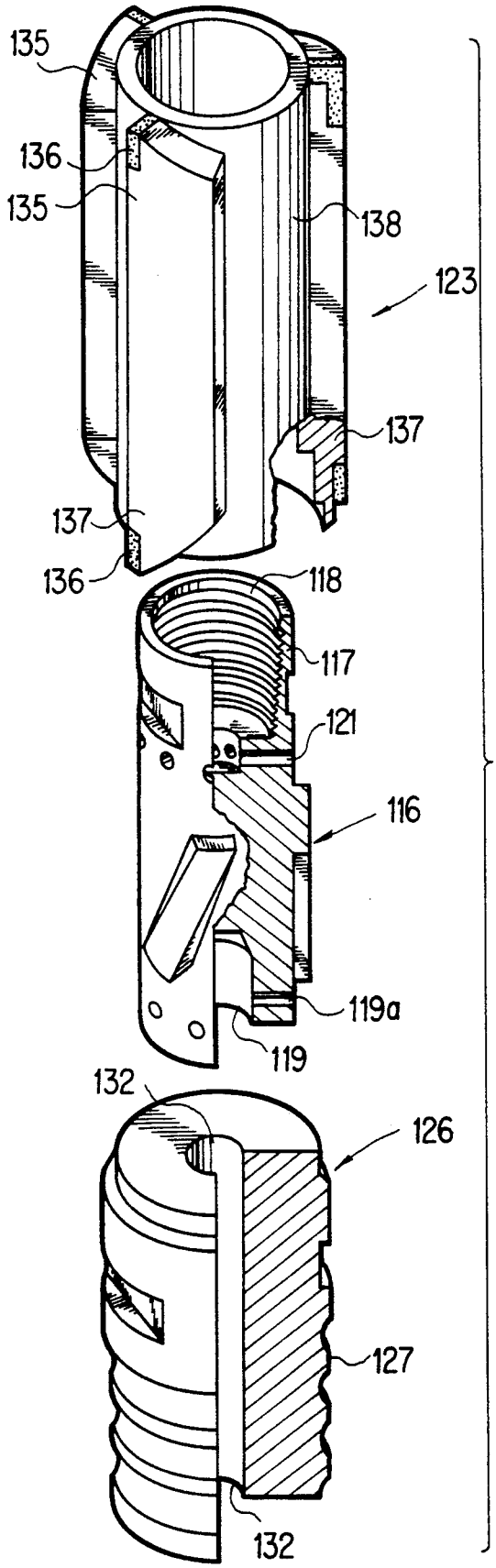
FIG. 6A is an exploded, part-sectional view of the adaptor components for the adaptor for a percussion hammer or rotary drill.

To clear the hole of any debris e.g. to allow the hammer 100 and bit 101 to be withdrawn from the hole, the drilling string is reversed (or rotation is simply stopped) and the body 16 moves up within the sleeve 23 until the intake passages 21 are exposed to direct the pressurized air up the hole (see FIG. 4). If the debris cannot be cleared with the air, the debris can be loosened with the teeth 35, and then blown up the hole.

Where the wall of the hole has collapsed, the drilling string can be positioned with the hammer 100 and drill bit 101 below the collapsed section. Grout can be pumped down the passage 14 and out the intake passages 21 and up the hole. When the grout has at least partially set, the drilling string can be rotated and raised so that the teeth 35 can cut a smooth bore in the grouted (i.e. repaired section) of the hole.

Preferably the diameter of the adaptor 10 is just smaller than the diameter of the drill hole so that the adaptor 10 can act to stabilize the lower end of the drill string 11.

In a modified embodiment not shown, the sleeve 23 can be of smaller diameter than the drill hole and have an enlarged section or periphery flange with an external diameter substantially equal to the diameter of the hole so that the adaptor can act as a stabilizer for the lower end of the drilling string 11.

With the reverse circulation pneumatic percussion hammer 100 attached to the adaptor 10, the adaptor 10 can be in the flushing or withdrawal mode (see FIG. 4) as the hammer 100 is lowered to the bottom of the hole so that the hammer is isolated from the pressurized air. When the bit 101 in the hammer 100 engages the bottom of the hole, the sleeve 23 will move up the body 16 to place the adaptor in the operating mode (see FIG. 3) and air is supplied to the hammer 100 to drive it. If the drilling string 11 is raised, the hammer 100 will be automatically shut off. (The hammer 100 will also be shut off if it drills down a preset depth and the drilling string 11 is not simultaneously advanced down the hole.)

Referring now to FIGS. 6 to 9, the adaptor 110 for a pneumatic percussion hammer or a rotary drilling string, the body 116, sleeve 123 and mounting block 126 are generally similar to those components hereinbefore described.

The body 116 has a head 117 with a screw-threaded bore 118 attachable to the lower end of the drilling string 111 which has a central pressure line 114. Intake passages 121 extend radially through the body 116 from the bore 118; while exhaust ports 119*a* extend radially from an exhaust bore 119 at the lower end of the body.

The sleeve 123 has upper and lower teeth 135, 137, with tungsten-carbide inserts 136 hereinbefore described with reference to the sleeve 23 but the grooves or reliefs 138 are much wider to allow the air and earth to pass up the outside of the adaptor 10 while the drilling is being effected.

The mounting block 126 has helical threads 127 to engage the hammer or drill bit 200 and it has a central air intake passage 132.

Figure 7:
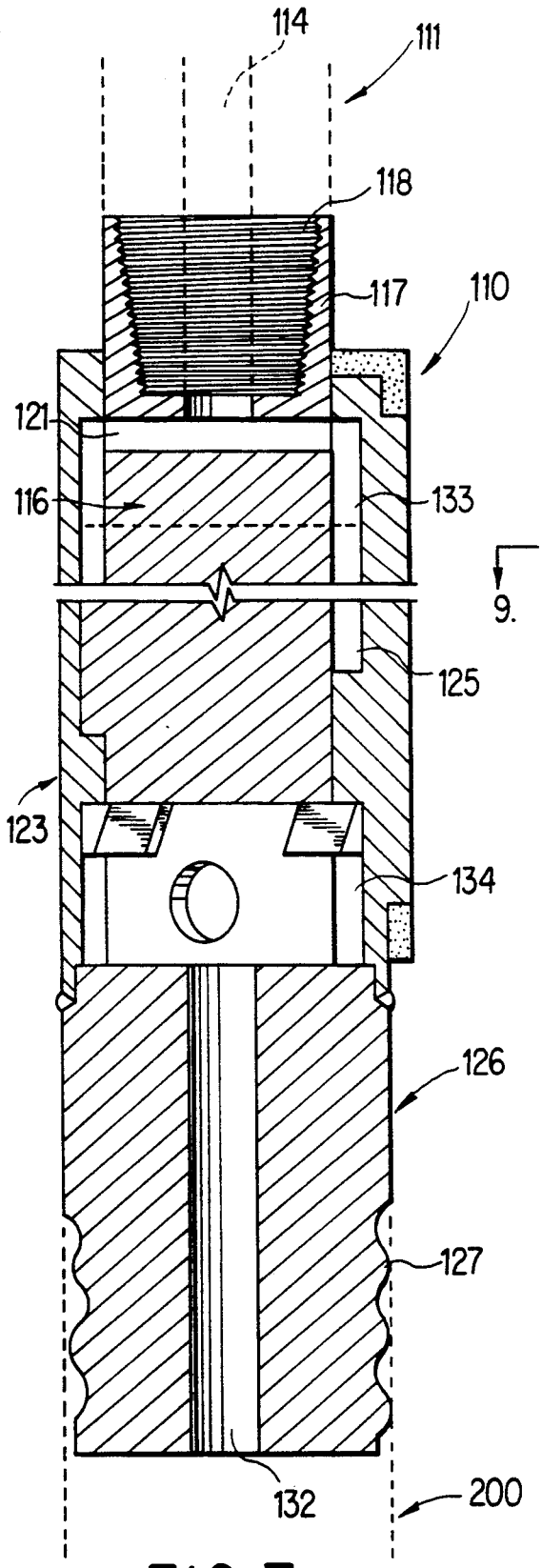
FIGS. 7 and 8 are respective sectional side views of the adaptor in its drilling mode and its flushing or withdrawal mode.

The operation of the adaptor 110 is generally the same as for adaptor 10. As shown in FIG. 7, in the drilling mode, pressurized air from the central pressure line 114 of the drill string 111 is directed via the bore 118 and intake passage 121 to the first chamber 133, down the air passages 125 to the second chamber 134, through the exhaust ports 119*a* and exhaust passage 119 in and down the air intake 132 in the mounting block 126 to the hammer or drilling bit 200. The air and earth then passes up past the adaptor 110, through the grooves or reliefs 138 about the sleeve.

Figure 8:
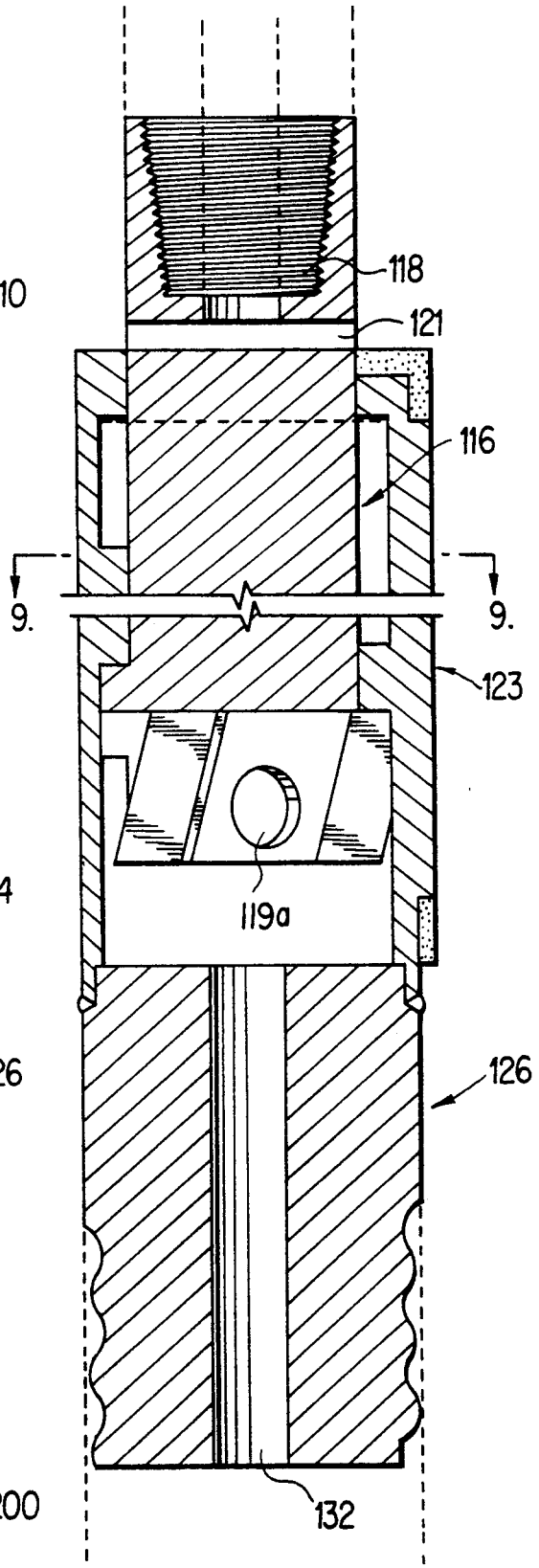
Figure 9:
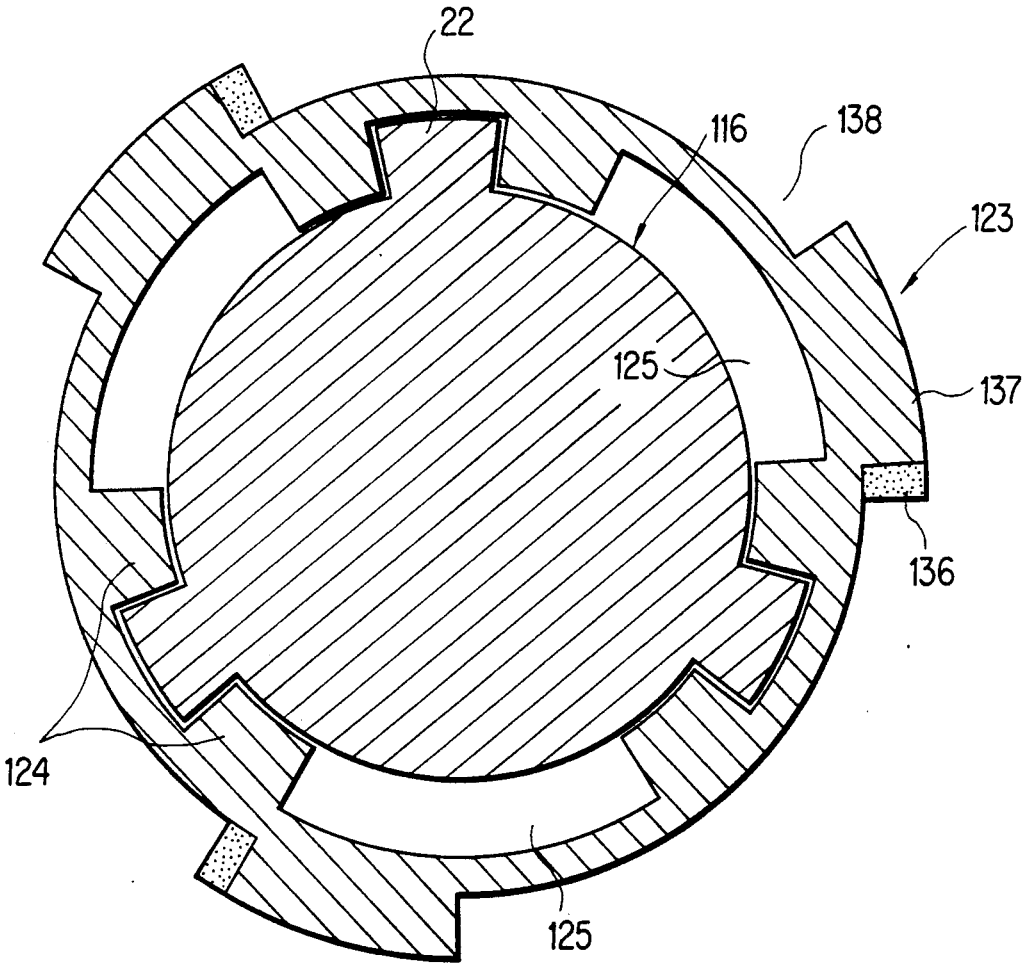
FIG. 9 is a sectional plan view taken on line 9—9 on FIG. 8.

To clear the hole, the rotation of the drill string 111 is stopped and the sleeve 123 moves down relative to the body 116 via the helical splines 122, 124 on the body and sleeve respectively. The air is then directed via the intake passages 121 to the drill hole to clear the debris as shown in FIG. 8. If necessary the drill string 111 may be rotated to enable the teeth 135 or 137 to cut through the obstruction in the drill hole.

Referring now to FIGS. 10 to 12, the sleeve 223 and body 216 may be modified. The helical splines 22, 122 on the body are replaced by vertical ribs 222 with an inclined (or ramp face) 222*a* over at least the lower half of one side of the vertical rib 222. The sleeve 223 has respective pairs of vertical ribs 224 where one has an inclined face 224*a* complementary to the ramp face 222*a*.

As illustrated in FIGS. 11 and 12, the vertical ribs 222 224 and their inclined faces 222*a*, 224*a* allow the required rotational and longitudinal movement between the body 216 and sleeve 223 to selectively direct the pressurized air to the drilling equipment or to flush the drilling hole as hereinbefore described with reference to FIGS. 1 to 5 and FIGS. 6 to 9 respectively.

Figure 13:
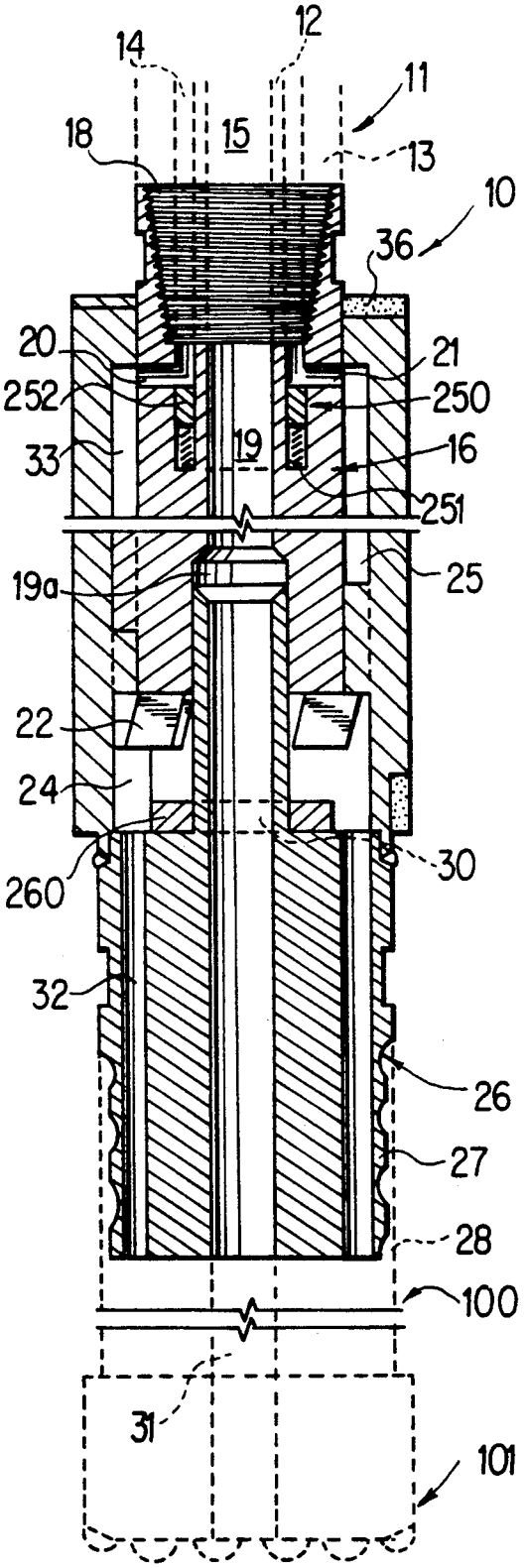
FIGS. 13 and 14 are respective section side views of a modified form of the adaptor of FIGS. 3 and 4.
Figure 14:
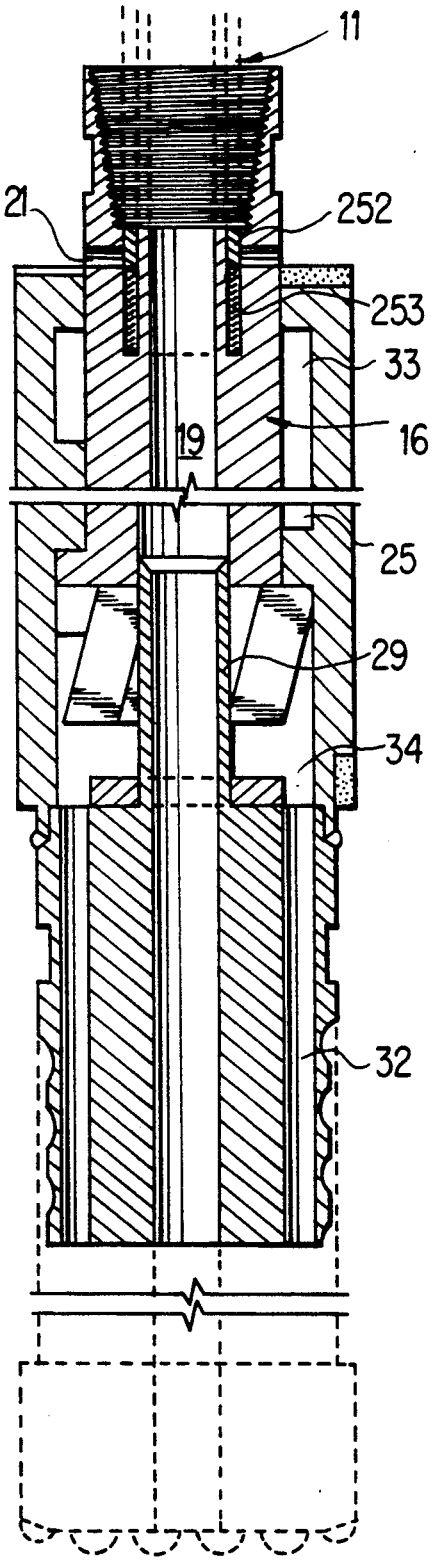

FIGS. 13 and 14 show a modified form of the reverse circulation adaptor of FIGS. 3 and 4.

A seal assembly 250 is provided in the adaptor body 16 to selectively close the intake passages 21 against ingress of rubbish into the adaptor when the adaptor in its flushing or withdrawal mode and the air, supplied by the pressure passage 14, is switched off.

An annular groove 251 is provided in the face adaptor body 16 and an annular sealing ring 252 (eg. of metal, plastic or rubbish) is located in the groove 251 and is backed by a compression spring 253 which urges the sealing ring 252 to the advanced position shown in FIG. 14.

When the adaptor 10 is in the drilling mode see FIG. 13), the air pressure through the intake ports 20 causes the sealing ring 252 to be retracted, against the compression spring 253, into the groove 251, to allow unrestricted air flow through the intake ports 20 to the intake passages 21.

When the air is shut off, the compression spring 253 advances the sealing ring 252 from the groove 251 to close off the intake ports 20.

When the adaptor 10 is moved to the flushing or withdrawal mode (see FIG. 14), the intake passages 21 are exposed to the exterior of the adaptor 10 and debris may enter the adaptor 10 through these passages but is prevented from doing so by the sealing ring 252.

When the air is switched on to clear the debris from the hole, the air pressure will retract the sealing ring 252 into its groove 251 and the air will flow out of the intake passages 21 unimpeded to flush the hole.

A vibration dampening ring 260 is provided in the chamber 34 at the upper end of the mounting block 26, around the tubular extension 29. The vibration dampening ring is formed of plastics or rubber and may be metal-backed.

In the drilling mode (see FIG. 13), the vibration dampening ring 260 is engaged by the lower end of the body 16 and operates to absorb/cushion/dampen any relative movement between the body 16 and the mounting block 26, should the bit 101 strike any hard surfaces. This reduces the shock loads fed from the bit 101, through the adaptor 10, to the drill string 11 and so ensures greater useful life for the drilling assembly.

Figure 15:
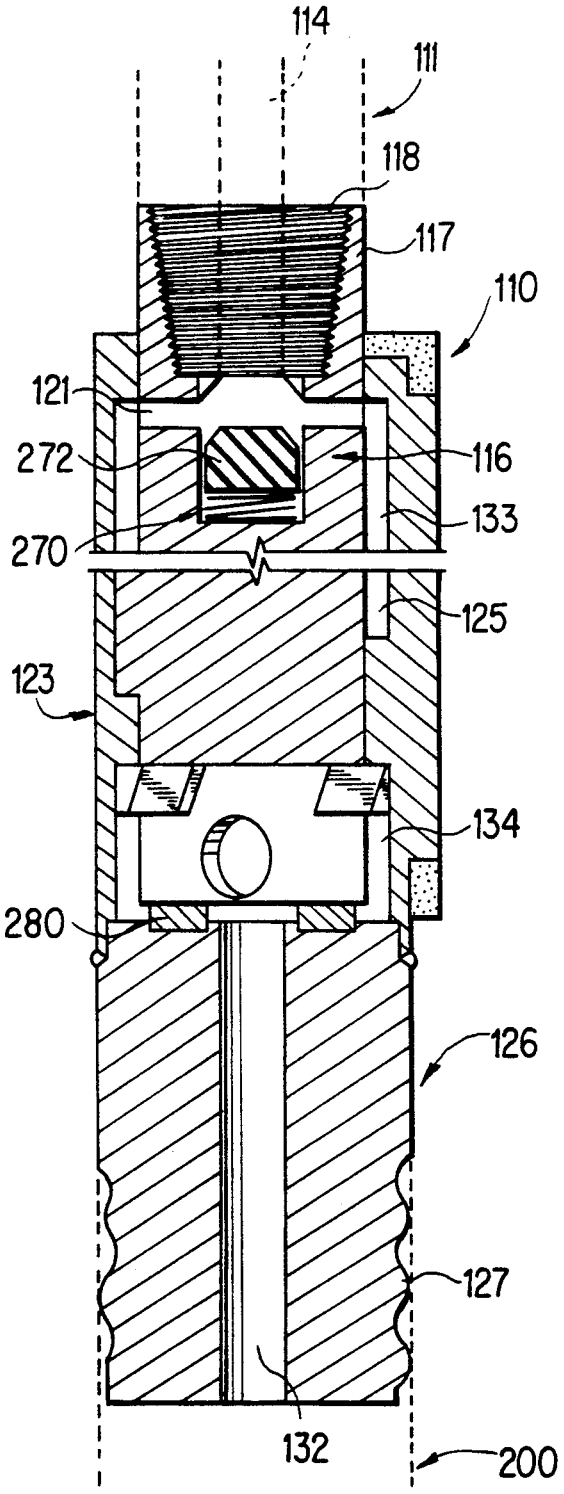
FIGS. 15 and 16 are respective sectional side views of a modified form of the adaptor of FIGS. 7 and 8.
Figure 16:
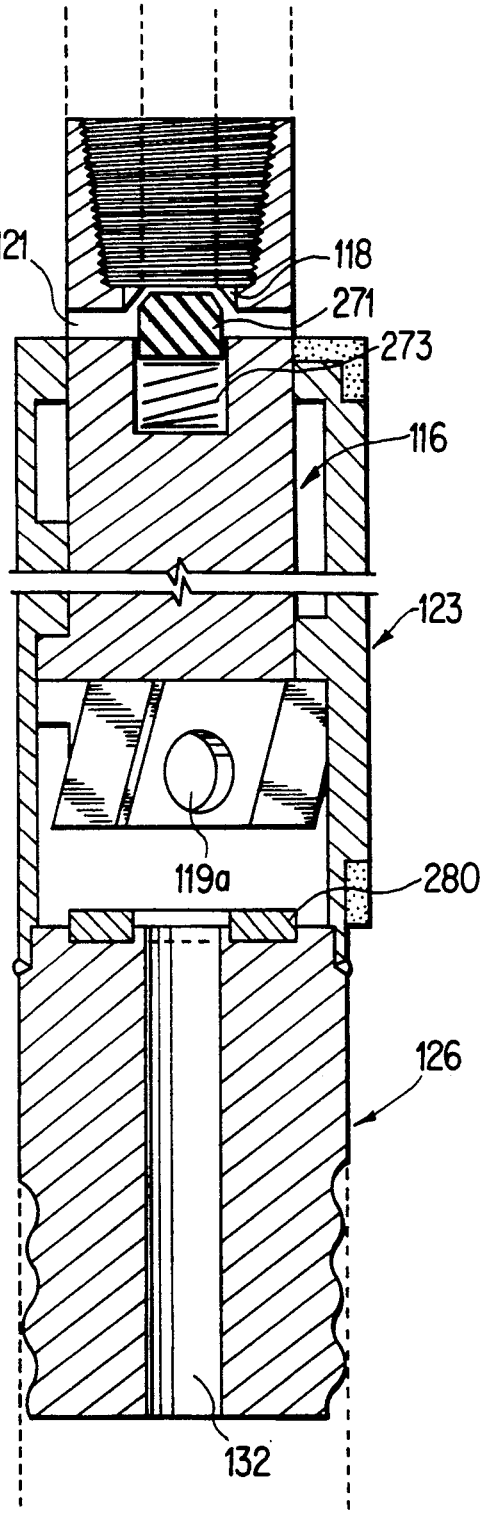

Referring now to FIGS. 15 and 16, the seal assembly 270 has a rubber or plastic sealing plug 271 received in a bore 272 in the body 116, backed by a compression spring 273, to selectively close the central pressure line 114 and intake passages 121 in the manner, and for the purpose, hereinbefore described with reference to FIGS. 13 and 14.

An annular vibration dampening ring 280 is provided at the upper end of the mounting block 126, engageable by the lower end of the body 116, in the manner, and for the purpose, hereinbefore described with reference to the vibration dampening ring 260 in FIGS. 13 and 14.

If preferred, the vibration dampening rings 260, 280 may be replaced by a plurality of resilient buttons fixed to the upper ends of the mounting blocks 26, 126.

It will be readily apparent to the skilled addressee that the present invention enables the drilling equipment to be recovered and it is virtually impossible that it will become jammed or stuck in the hole and have to be abandoned; provides means to repair or stabilize the hole; provides stability for the drilling string; full flushing of the hole; accurate sample drilling as the adaptor is substantially the same size as the drilling bit; enables fluids, chemicals, additives, or grouts to be pumped back up the hole and enables a quick change of drilling equipment. For extended life, the adaptor may be provided with an anti-wear coating.

Various other advantages of the present invention will be apparent to the skilled addressee, who will appreciate that modifications and variations can be made to the embodiments described without departing from the scope of the present invention defined in the appended claims.

I claim:

1. An adaptor in a drilling string for a percussion hammer or a rotary drill bit, which comprises:

a body having a head screw-threadably mountable on the lower end of a drilling string, and having at least one intake passage extending substantially radially through the body and arranged to communicate with a pressure pipe of the drilling string;

a sleeve rotatably mounted on the body and longitudinally movable relative thereto;

a mounting block mountable on the lower end of the sleeve and movable therewith relative to the body and arranged for connection to a percussion hammer or drilling bit and having at least one air intake passage connectable with an air intake port in the percussion hammer or drilling bit;

a first variable volume chamber defined by the body and the sleeve;

a second variable volume chamber defined by the body and the sleeve;

a second variable volume chamber defined by the body, the sleeve and the mounting block; and air passage means connecting the first and second chambers and so arranged that in a first position of the sleeve relative to the body, pressurized air from pressure pipe is directed through the intake passage in the body to the first chamber, along the air passage means to the second chamber, and through the air intake passage in the mounting block to the air intake port in the percussion hammer or the drilling bit, and in a second position of the sleeve relative to the body where the pressurized air is directed into the drill hole above the adaptor to clear debris from the drill hole, wherein:

a bore is provided in the body below, and in communication with, the intake passage; and a sealing ring is provided in the bore and is urged to an extended position from a groove formed in the body by a compression spring; the foregoing being so arranged such that in the second position of the sleeve, and when the pressurized air from the pressure pipe is shut off, the sealing ring closed the intake passage to prevent the ingress of debris into the adaptor but is retracted against the compression spring when the pressurized air from the pressure pipe is directed through the intake passage to clear debris from the drill hole.

2. An adaptor in a drilling string for a percussion hammer or a rotary drill bit, which comprises:

a body having a head screw-threadably mountable on the lower end of a drilling string, and having at least one intake passage extending substantially radially through the body and arranged to communicate with a pressure pipe of the drilling string;

a sleeve rotatably mounted on the body and longitudinally movable relative thereto;

a mounting block mountable on the lower end of the sleeve and movable therewith relative to the body and arranged for connecting to a percussion hammer or drilling bit and having at least one air intake passage connectable with an air intake port in said percussion hammer or drilling bit;

a first variable volume chamber defined by the body and the sleeve;

a second variable volume chamber defined by the body, sleeve and the mounting block; and air passage means connecting the first and second chambers, and so arranged that in a first position of the sleeve relative to the body, pressurized air from pressure pipe is directed through the intake passage in the body to the first chamber, along the air passage means to the second chamber, and through the air intake passage in the mounting block to the air intake port in the percussion hammer or the drilling bit, and in a second position of the sleeve relative to the body where the pressurized air is directed into the drill hole above the adaptor to clear debris from the drill hole, wherein an annular vibration dampening ring of resilient material is provided in the second chamber on the upper end of the mounting block, the dampening ring being engageable by the body when the sleeve is in the first position to dampen shock loads transmitted to the adaptor by the percussion hammer or drilling bit.

3. An adaptor for reverse circulation drilling strings, which comprises:

a body having a head screw-threadably mountable on the lower end of a drilling string, a substantially central exhaust passage for communicating with the exhaust pipe of the drilling string and at least one intake passage extending substantially radially through the body and arranged to communicate with a pressure pipe of the drilling string, the pressure pipe surrounding the exhaust pipe;

a sleeve member rotatably mounted on the body and longitudinally movable relative thereto;

a mounting block mountable on the lower end of the sleeve and movable therewith relative to the body and arranged for connection to drilling equipment and having a substantially central exhaust passage to provide a connection between the exhaust passage in the body and an exhaust port in the drilling equipment and at least one air intake passage connectable with an air intake port in the drilling equipment:

a first variable volume chamber defined by the body and the sleeve;

a second variable volume chamber defined by the body, the sleeve and the mounting block; and air passage means connecting the first and second chambers, and so arranged that in a first position of the sleeve relative to the body, pressurized air from the pressure pipe is directed through the intake passage to the first chamber along the air passage means to the second chamber, and through the air intake passage in the mounting block to the air intake port in the drilling equipment, and in a second position, where the pressurized air is directed into the drill hole above the adaptor to clear debris from the hole, wherein:

an annular groove is provided in the body below, and in communication with, the intake passage; and a sealing ring is provided in the groove and is urged to an extended position from the groove by a compression spring; and so arranged that in the second position of the sleeve, and when the pressurized air from the pressure pipe is shut off, the sealing ring closes the intake passage to prevent the ingress of debris into the adaptor but is retracted against the compression spring when the pressurized air from the pressure pipe is directed through the intake passage to clear debris from the drill hole.

4. An adaptor for reverse circulation drilling strings which comprises:

a body having a head screw-threadably mountable on the lower end of a drilling string, a substantially central exhaust passage to communicate with the exhaust pipe of the drilling string and at least one intake passage extending substantially radially through the body and arranged to communicate with a pressure pipe of the drilling string, the pressure pipe surrounding the exhaust pipe;

a sleeve member rotatably mounted on the body and longitudinally movable relative thereto;

a mounting block mountable on the lower end of the sleeve and movable therewith relative to the body and arranged for connection to drilling equipment and having a substantially central exhaust passage to provide a connection between the exhaust passage in the body and an exhaust port in the drilling equipment and at least one air intake passage connectable with an air intake port in the drilling equipment;

a first variable volume chamber defined by the body and the sleeve;

a second variable volume chamber defined by the body, the sleeve and the mounting block; and air passage means connecting the first and second chambers, and so arranged that in a first position of the sleeve relative to the body, pressurized air from the pressure pipe is directed through the intake passage to the first chamber along the air passage means to the second chamber, and through the air intake passage in the mounting block to the air intake port in the drilling equipment, and in a second position, where the pressurized air is directed into the drill hole above the adaptor to clear debris from the hole, wherein an annular vibration dampening ring of resilient material is provided in the second chamber on the upper end of the mounting block, the dampening ring being engageable by the body when the sleeve is in the first position to dampen shock loads transmitted to the adaptor by one of a percussion hammer and drilling bit.

* * * * *